United States Patent [19]

Takaniemi

[11] 4,296,980

[45] Oct. 27, 1981

[54] AUTOMATON FOR DEALING OUT FOOD AND DRINK

[76] Inventor: Tauno K. Takaniemi, Näsilinnankatu 30 B 31, SF-33200 Tampere 20, Finland

[21] Appl. No.: 50,846

[22] Filed: Jun. 20, 1979

[51] Int. Cl.[3] ..... A47F 3/02; B65B 59/00; B65D 83/08

[52] U.S. Cl. ..... 312/35; 312/42; 312/60; 312/117; 312/306; 221/91

[58] Field of Search ..... 312/35, 41, 42, 45, 312/60, 117, 297, 306; 221/69, 89, 91

[56] References Cited

U.S. PATENT DOCUMENTS

| | | | |
|---|---|---|---|
| 1,839,840 | 1/1932 | Fry | 312/35 |
| 1,839,842 | 1/1932 | Fry | 312/35 |
| 1,848,248 | 3/1932 | Fry | 194/63 |
| 1,865,895 | 7/1932 | Fry | 221/91 |
| 3,137,533 | 6/1964 | Acker | 312/35 |
| 3,175,729 | 3/1965 | Fyte | 312/42 X |
| 3,433,545 | 3/1969 | Rainey | 312/42 |
| 4,007,853 | 2/1977 | Bahneman | 312/42 X |

FOREIGN PATENT DOCUMENTS

| | | |
|---|---|---|
| 2103702 | 3/1972 | France . |
| 1140341 | 1/1969 | United Kingdom . |

*Primary Examiner*—Victor N. Sakran
*Attorney, Agent, or Firm*—Pollock, Vande Sande & Priddy

[57] ABSTRACT

The present invention relates to an automatic apparatus for dispensing or vending food and drink or other products having a rather small volume. The locking mechanism of the apparatus is based on the utilization of gravity. An electromagnetically actuated locking bolt is used to hold a segmented, serially folding door in a desired position, the door being so constructed that whenever the bolt is withdrawn, the door moves downwards due to gravity. As it moves downward, the lower segments of the door serially fold down into a magazine located below the locking mechanism and the upper segment of the door opens a space in which food or drink or other products are located.

8 Claims, 3 Drawing Figures

AUTOMATON FOR DEALING OUT FOOD AND DRINK

BACKGROUND OF THE INVENTION

Automatic dispensers are known in which the spaces for the products are arranged at the flanks of a cylinder rotating round its vertical axis so that after actuation of a locking mechanism, the cylinder rotates to an opening from which the consumer can remove the product. A disadvantage of dispensers of this kind is their large size and the complicated construction of the electrical equipment required to operate the locking mechanism and rotate the cylinder. Another disadvantage of some dispensers of this kind is that the consumer cannot easily determine the condition of the product before making payment. The product can be damaged or injured during dispensing because it can nearly come out of its space during rotation. The structure of this kind of dispenser also makes cleaning very hard and time-consuming.

Dispensers for food and drink are also known having visible spaces each with its own door. The disadvantages of the previously mentioned cylindrical dispensers are avoided, as far as cleaning and identifying the product before payment are concerned. However, the disadvantage of these dispensers is that every space must have its own door and corresponding locking mechanism. This makes the construction of the dispenser very complicated, adds weight and makes the production costs rather high. Some of these factors partly diminish reliability in operation.

French Pat. No. 2 103 702 discloses a dispenser in which attempts have been made to avoid the disadvantages of the previously mentioned devices. The apparatus according to this specification can be opened from the upper side and is meant for dispensing bottles, for example. The spaces for the products are closed by a cover made of elastic material which during the use of the dispenser is manually displaced and rolled up into a magazine. The disadvantages of this apparatus are that the locking mechanism is rather complicated and the cover is continuously elastic material, which firstly is easy to break and secondly is rather hard to put into a sufficiently small space. Furthermore, since the cover is manually actuated, damage may result when force is used to open the cover, especially when the locking mechanism isn't in order.

SUMMARY OF THE INVENTION

The purpose of the present invention is to remove the disadvantages of the previously known devices by providing a dispenser in which a single, segmented folding door is arranged to close several vertically stacked spaces so that the door opens one space at a time, when the locking mechanisms opens and gravity forces the door to move downward serially. The only electrical device is the electromagnetic locking mechanism of the door. These are provided in a dispenser in accordance with the annexed claims.

BRIEF DESCRIPTION OF THE DRAWINGS

One embodiment of the invention is described in the following specification with simultaneous reference to the enclosed drawings in which.

DESCRIPTION OF THE PREFERRED EMBODIMENTS

Figure 1:
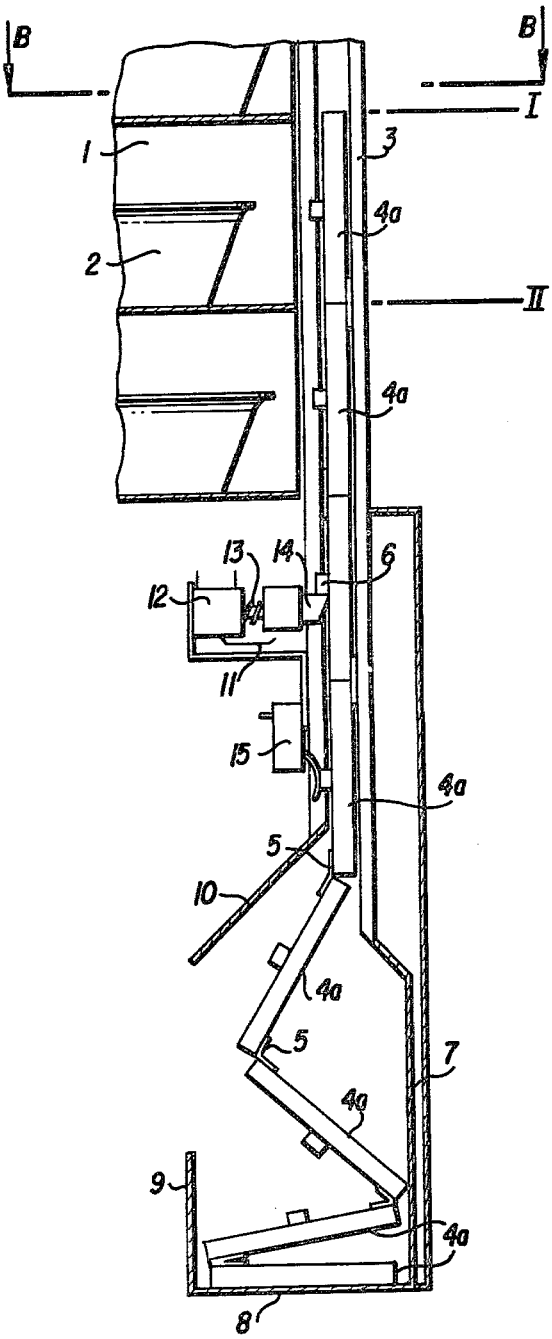
FIG. 1 shows the door and the locking mechanism in accordance with the invention viewed from one side in a partial section along the line A—A in FIGS. 2 and 3.
Figure 2:
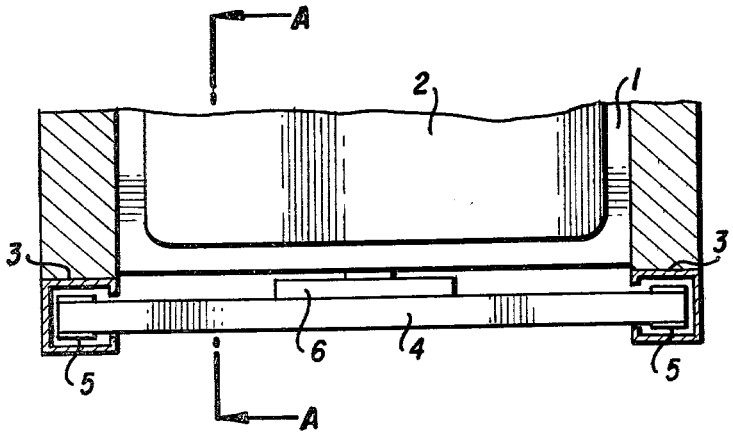
FIG. 2 shows a partial section along the line B—B in FIGS. 1 and 3.

As illustrated in FIGS. 1 and 2, a suitable number of shelf spaces 1 are arranged one upon the other to house products 2. At the front side of spaces 1, a pair of vertical guide tracks or slides 3 is provided within which a segmented door 4 is arranged to slide. Door 4 is made of quadrangular panels 4*a* of the equal size which may be of acrylyl plastic materials, for example. These panels are connected together with joints 5 made, for example, of flexible plastic material. The suitable place for the joints 5 is inside guide tracks 3, as shown in FIG. 2. The preferred size of panels 4*a* is that of the frontal openings of spaces 1. A horizontally extending stop 6 is attached to each panel 4*a* at a convenient place. When the door 4 is at its uppermost position it can move serially down in the way to be described and simultaneously fold into a small space inside the walls 7–10 below guide track 3.

An electromagnetic locking mechanism 11 is attached to the apparatus preferably underneath spaces 1. This locking mechanism is controlled by a known type of ordinary coin-lock (not shown) and a selecting keyboard (not shown) by which the switch (not shown) is actuated to control electromagnetic locking mechanism 11. Mechanism 11 comprises an electromagnet 12 and a locking bolt 14, which is biased outwardly beneath stop 6 by a spring 13. The apparatus also comprises a micro-switch 15 located below electromagnetic locking mechanism 11. The purpose of switch 15 is to disconnect the electric current from the electromagnet 12 during the use of the dispenser.

The dispenser functions in the following manner. After putting in the right amount of money into the coin-lock (not shown), the user presses the appropriate key of the selecting keyboard (not shown), so that an electric impulse goes from the key to the switch (not shown) which inactivates the other possible locking mechanism. At the same time the impulse causes electromagnet 12 to draw the locking bolt 14 towards itself so that stop 6 attached to the adjacent panel 4*a* of the door 4 is released and the door 4 falls freely down because of gravity.

The micro-switch 15 is so placed that it disconnects the current to electromagnet 12 before or at the very moment when the next stop 6 is just above locking bolt 14, which is released and moves towards the door under the influence of spring 13 so that door 4 is locked when stop 6 catches on bolt 14. The door has come down from the position I in FIG. 1 to the position II. Because the distance between positions I and II corresponds to the height of panel 4*a* and place 1, the product 2 can be removed from place 1, which is right beneath the position I in FIG. 1. As door 4 moves downward from position I to position II, panels 4*a* are folding into the magazine 7–10 below guide track 3. The disconnecting of the current by the micro-switch 15 simultaneously enables the coin-lock to accept more money.

Filling the dispenser is done when the door 4 is at its lowest position. The products 2 are put into each place 1 and the electromagnetic locking mechanism 11 is disconnected by a by-pass switch (not shown). The door 4 then is pulled up to its uppermost position and mechanism 11 is activated to lock the door.

Figure 3:
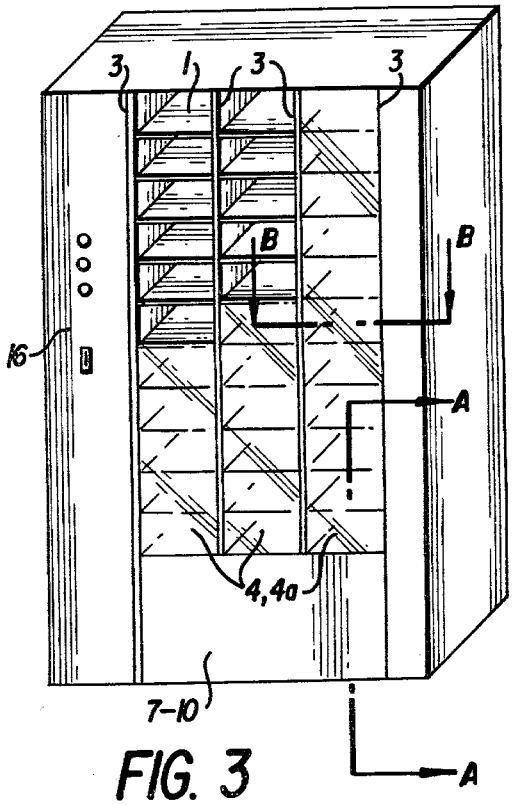
FIG. 3 shows one possible embodiment of the invention in the perspective view.

FIG. 3 shows one possible embodiment of a dispenser according to the idea of the invention. It has three dispensing stations side by side and at the left side of the figure there is a keyboard and coin-lock mechanism 16. Of course it is possible to put additional dispensing stations side by side in the same way.

This apparatus has many advantages compared with those previously known for the same purpose. One of the most important advantages is that a dispenser according to the invention weighs less than the conventional devices. This is because its moving masses are very little. Furthermore this dispenser has only one moving electrical component so that the risk of the failure is very little. Also, low voltage can be used if needed. This can sometimes be necessary because of safety. Filling up and cleaning are very easy to do and the consumer can always see the product he is buying.

A dispenser according to the invention can be adapted to dispense refrigerated products, magazines and the like. The embodiment described is only one example. The basic idea can be adapted to various purposes according to the following claims.

I claim:

1. An apparatus for dispensing products, comprising:

a plurality of product receiving shelf spaces arranged one above the other;

a door comprising a corresponding plurality of interconnected panels each sized to close one of said product receiving shelf spaces, said door being arranged for movement due to the effects of gravity, downward past said shelf spaces; and means for selectively stopping movement of said door downwardly past said shelf spaces to permit serial removal of products from said shelf spaces.

2. An apparatus according to claim 1, wherein said means stops movement of said door after it has dropped the height of one of said shelf spaces.

3. An apparatus according to claim 1, wherein said panels are made from a transparent, unbreakable material.

4. An apparatus according to claim 1, wherein said panels are connected by joints of flexible material.

5. An apparatus according to claim 1, wherein there are a plurality of adjacent rows of said product receiving shelf spaces, each row having its own door and means for stopping movement of its door.

6. An apparatus for dispensing products, comprising:

a plurality of product receiving shelf spaces arranged one above the other;

a door comprising a corresponding plurality of panels connected by joints of flexible material, each panel being sized to close one of said product receiving shelf spaces;

guide tracks arranged for permitting movement of said door due to the effects of gravity, downward past said shelf spaces, said joints of flexible material being positioned to move within said guide tracks; and means for selectively stopping movement of said door downwardly past said shelf spaces to permit serial removal of products from said shelf spaces.

7. An apparatus for dispensing products, comprising:

a plurality of product receiving shelf spaces arranged one above the other;

a door comprising a corresponding plurality of panels connected by joints of flexible material, each panel being sized to close one of said product receiving shelf spaces, said door being arranged for movement due to the effects of gravity, downward past said shelf spaces;

a magazine located below said shelf spaces, within which said door folds due to said panels and flexible joints; and means for selectively stopping movement of said door downward past said shelf spaces into said magazine, to permit serial removal of products from said shelf spaces.

8. An apparatus for dispensing products, comprising:

a plurality of product receiving shelf spaces arranged one above the other;

a door comprising a corresponding plurality of interconnected panels each sized to close one of said product receiving shelf spaces, said door being arranged for movement due to the effects of gravity, downward past said shelf spaces;

a corresponding plurality of stops, one attached to each of said interconnected panels; and a locking mechanism having a selectively movable bolt for serially contacting said stops to stop said door and permit serial removal of products from said shelf spaces.

* * * * *